United States Patent [19]

Brackmann et al.

[11] 3,989,052

[45] Nov. 2, 1976

[54] TOBACCO FILLER ROD PRODUCTION

[75] Inventors: Warren A. Brackmann, Cooksville; Daniel DiIanni, Toronto, both of Canada

[73] Assignee: Rothmans of Pall Mall Canada Limited, Toronto, Canada

[22] Filed: Mar. 27, 1975

[21] Appl. No.: 562,448

Related U.S. Application Data

[63] Continuation-in-part of Ser. No. 384,916, Aug. 2, 1973, abandoned, which is a continuation of Ser. No. 175,926, Aug. 30, 1971, abandoned, which is a continuation-in-part of Ser. No. 128,412, March 26, 1971, abandoned.

[30] Foreign Application Priority Data

Mar. 28, 1974 United Kingdom ..... 13886/74

[52] U.S. Cl. ..... 131/84 B; 131/110

[51] Int. Cl.[2] ..... A24C 5/18

[58] Field of Search ..... 131/84 B, 84 R, 84 C, 131/21 D, 110, 60–66, 108–109 R, 109 B

[56] References Cited

UNITED STATES PATENTS

| | | | |
|---|---|---|---|
| 3,196,880 | 7/1965 | Pinkham | 131/84 R |
| 3,563,249 | 2/1971 | Geyer et al. | 131/84 B |
| 3,779,252 | 12/1973 | Brackmann et al. | 131/84 B |

FOREIGN PATENTS OR APPLICATIONS

| | | | |
|---|---|---|---|
| 1,157,125 | 11/1963 | Germany | 131/84 C |
| 266,385 | 10/1913 | Germany | 131/109 B |
| 1,068,663 | 5/1967 | United Kingdom | 131/84 B |

*Primary Examiner*—John F. Pitrelli
*Attorney, Agent, or Firm*—Sim & McBurney

[57] ABSTRACT

A tobacco filler rod having improved filling power, improved uniformity of quality of tobacco along its length and improved distribution of sizes of tobacco particles in the cross section of the filler rod is formed by dividing the tobacco particles of a vertically-moving relatively wide and thin stream of tobacco particles into a plurality of narrow continuous substreams of tobacco each having substantially the same quantity of tobacco therein by the use of suction, conveying the substreams under the influence of suction out of contact with the relatively wide stream and forming the filler rod by gentle intact layering of the substreams one on top of another on a filler rod-forming surface.

11 Claims, 14 Drawing Figures

TOBACCO FILLER ROD PRODUCTION

REFERENCE TO RELATED APPLICATIONS

This application is a continuation-in-part of application Ser. No. 384,916 filed Aug. 2, 1973 (now abandoned), which itself is a continuation of application Ser. No. 175,926 filed Aug. 30, 1971 (now abandoned), the latter application being a continuation-in-part of application Ser. No. 128,412 filed Mar. 26, 1971 (now abandoned).

FIELD OF INVENTION

The present invention relates to the methods for the formation of a tobacco filler rod for use in the production of cigarettes.

BACKGROUND TO THE INVENTION

In the conventional formation of tobacco filler rods, a relatively wide and thin or broad stream of tobacco particles of varying sizes, usually approximately 36 inches wide, first is provided, moving vertically upwardly or downwardly towards a filler rod-forming belt moving transverse to the direction of movement of the tobacco particles. This relatively wide stream usually is provided with as even as possible distribution of tobacco across its width by various means. The tobacco particles of the relatively wide stream are gathered together on the intercepting surface of the transversely-moving belt to form a narrow filler rod thereon which has generally-increasing depth across the width of the relatively wide stream in the direction of movement of the belt. Cigarettes are formed from the continuous filler rod recovered from the gathering operation usually by lateral compression of the filler rod, followed by wrapping of the compressed rod in paper to form a continuous cigarette rod, from which individual cigarettes may be cut.

In the formation of the filler rod from a falling stream of tobacco particles, to reduce the tendency of tobacco particles to be displaced longitudinally of the narrow filler rod in a direction opposite to the direction of movement of the narrow rod-forming belt during collection of the particles to form the filler rod, thereby forming knots, balls or concentrations of particles in the forming filler rod and hence introducing lack of uniformity of tobacco weight into the filler rod stream, it has become common practice to construct the gathering belt as a flat narrow belt of air-permeable and tobacco-impermeable material and to apply a gentle vacuum through the surface. This use of a gentle vacuum has been thought to grip the tobacco particles to the surface of the belt upon contact thereby diminishing the tendency of the narrow filler rod to ball up.

Close examination by high speed photography of the gathering of the falling broad stream into a narrow filler rod of tobacco particles has revealed that, while the gentle vacuum is to a certain degree effective in preventing displacement of the particles in those portions of the conveyor where the forming filler rod is relatively thin, in thicker portions considerable peaks and valleys of tobacco particles in the forming stream occur as the vacuum loses its effectiveness on the particles remote from the surface and hence control is lost of the movement of the particles from the falling stream into the filler rod moving transverse to the direction of movement of the falling stream. This problem is compounded as the speed of filler rod-forming procedure increases.

The formation of peaks and valleys in the filler rod in this way results in a filler rod having a non-uniform weight distribution of tobacco along its length. Formation of cigarettes from such a filler rod would lead either to an inconsistent product or the rejection of a large number of cigarettes which did not conform to a narrow weight range. Either result is plainly unsatisfactory.

Similar lack of weight uniformity arises when the filler rod is formed on a belt moving transverse to a relatively wide stream conveyed by an upwardly moving chute-confined air stream.

This prior art problem has lead to the feeding of excess quantities of tobacco in the relatively wide stream from which the filler rod is formed so that the resulting filler rod contains on average an excess of tobacco over that ultimately required to form the cigarette rod. This overfeeding of the rod-forming operation attempts to provide sufficient excess tobacco in the rod so that, irrespective of the variations in tobacco weight along the length of the filler rod, substantially all the filler rod length contains a quantity of tobacco in excess of that ultimately required in the cigarette rod.

The excess tobacco is trimmed from the filler rod after its formation so that the trimmed rod contains the quantity of tobacco required for feed to the wrapping procedure and has an improved uniformity of quantity of tobacco along its length as compared to a filler rod formed without overfeeding and trimming. Typically, about a 20% overfeed of tobacco is made requiring trimming and recycling of this overfed amount.

This prior art practice of overfeeding and trimming in attempting to overcome the weight uniformity problems arising from the assembly technique is objectionable from at least two standpoints. One such objection arises from the overfeeding of the filler rod assembly. With the need to increase the speed of formation of the filler rod for faster and more economic production of cigarettes, the runability of the cigarette making machine, i.e. its ability to make cigarettes on a continuous basis without breakdown, becomes a problem since it is forced to process much more tobacco than is required in the cigarettes thereby increasing the chances of the maker choking.

Another such objection arises from the trimming of large quantities of tobacco from the filler rod for recycle to the formation of the relatively wide stream. It has been found that the trimming of the tobacco filler rod decreases the "filling power" of the trimmed tobacco upon reuse. As indicated in U.S. Pat. No. 3,357,436, the "filling power" of tobacco is a measure of the ability of the tobacco to fill a cigarette tube. At a given hardness of cigarette, the less quantity of tobacco required to achieve that hardness, the greater is the filling power of that tobacco. Thus, decreasing the filling power of the tobacco by trimming leads to either less hard cigarettes or an increased tobacco requirement, the problem increasing with increased trimming.

The above-mentioned high speed photographic examination of the filler rod during its formation additionally indicated that smaller tobacco particles tend to penetrate the surface of the portions of the filler rod already formed on the conveyor belt while the larger particles tend to lie on the surface of the already-formed rod portion. From this expected observation of the different behaviour of the differently-dimensioned tobacco particles, there results, in effect, a classification of tobacco particle sizes over the cross section of the filler rod, with smaller tobacco particles tending to be located closer to the conveyor belt and larger tending to be located remote from the belt.

This classification may lead to the undesirable effects of bad ends to the cigarettes, uneven burning rates and uneven burning temperatures, with accompanying variations of smoke constituents and taste.

The prior art procedures suffer from a number of additional drawbacks to those discussed above which result in unsatisfactory cigarettes. One such additional drawback results from the manner of formation and conveying of the filler rod from its formation to the wrapping station. The filler rod typically is formed on and is conveyed on a substantially flat moving belt which runs in a channel between opposed stationary sidewalls which confine the rod laterally. There is, therefore, frictional contact between the sidewalls and the filler rod during its formation and conveying. Variations in the coefficient of friction between the tobacco and the sidewalls, resulting from variations in the tobacco and/or variations in the sidewalls themselves, for example, due to irregular tar build up, may lead to dislodgment of tobacco particles from the body of the rod or movement of tobacco paticles to different longitudinal positions in the rod, resulting in a worsened uniformity of tobacco along its length, leading to large numbers of cigarette rejects, and, under extreme conditions, the machine may become clogged, in which event, production would have to cease until the clog is removed.

Further, in conventional cigarette-making procedures, the filler rod has a relatively wide width when first formed and is manipulated to decrease its width during passage from the chute to the commencement of the wrapping procedure. This manipulation, due to the frictional contact between the constraining walls and the tobacco in the rod, may increase the side wall friction problem mentioned above.

Heretofore it has not been considered possible to form a filler rod having the width required for feed to the wrapping procedure, typically less than about 10 mm, particularly about 5 to about 10 mm, due to an increase in the control problems in the formation of the filler rod directly from the relatively wide tobacco stream with decreased width surface, especially at high speeds of formation of filler rods, typically above about 4,000 cigarettes per minute, even with the application of suction to the underside of the rod-forming belt. The control problems arise, as mentioned above, from the increasing thickness of the filler rod on the surface across the width of the relatively wide stream and the decreasing influence of suction with increasing depth. As the rod-forming surface of the belt is made thinner, the depth of tobacco in the rod on the belt increases, thereby increasing the control problem as compared with a wider rod-forming surface.

Hence, the prior art considered it necessary to form an overwide filler rod which later is compressed laterally to decrease its width to a size suitable for feed to the wrapping procedure.

SUMMARY OF INVENTION

The present invention is directed to improvements in filler rod-forming procedures which decrease or eliminate the prior art filler rod-forming problems as discussed above. The present invention also is directed to an improved cigarette rod-forming procedure for high speed production of a continuous cigarette rod having improved uniformity and which employs an economic tobacco utilization.

Broadly, in accordance with the present invention, there is provided a method for forming a narrow tobacco filler rod from a relatively wide and thin stream of tobacco particles moving substantially vertically which comprises forming a plurality of continuous narrow thin substreams of tobacco from the relatively wide stream by attracting and capturing tobacco particles from the relatively wide stream by the use of suction, conveying the substreams out of contact with the relatively wide stream and assembling the tobacco filler rod by gently intact layering of the substreams one on another on the filler rod-forming surface.

GENERAL DESCRIPTION OF INVENTION

Each "substream" of tobacco formed from the relatively wide stream is an individual elongate continuous narrow stream of tobacco of shallow thickness which itself is incapable of providing a filler rod stream but which when combined with the other substreams formed from the relatively wide stream forms a filler rod. Each individual substream generally contains the same quantity of tobacco.

In the present invention, a plurality of tobacco substreams first is formed from the tobacco particles of the relatively wide stream by suction, typically by the use of a plurality of shallow hollow discs situated across the width of the relatively wide stream and each having a continuous peripheral air-permeable and tobacco-impermeable surface and having its interior under a subatmospheric pressure whereby the suction is applied across the peripheral surface. Each of the discs rotates in the same direction about its axis and the axes of the discs are parallel to each other. Each disc is positioned with an arcuate portion of its peripheral surface facing the relatively wide stream and to intercept tobacco particles therefrom.

Since each of the substreams is relatively thin, as compared to the thickness of the filler rod, the suction applied across the peripheral surface of each disc controls the tobacco particles of the substream, as compared to the loss of control of the tobacco particles on the surface of the rod-forming belt in the prior art procedures as the thickness of the rod increases and the influence of suction decreases.

When the substreams have been formed, they are conveyed under the influence of suction out of interception with the relatively wide stream typically by the rotation of the shallow discs and are released from the conveying suction, typically by use of a vacuum shoe associated with each disc. The release substream particles are joined together on the filler rod-forming surface to provide the filler rod by gentle intact layering of the substreams one on top of another.

This assembly of the filler rod by the layering of the substreams is achieved by release of the leading particles of the substream when they are adjacent to, moving in the same direction as and moving at the same speed as the filler rod-forming surface so that the particles of the substream retain their juxtaposition on the rod-forming surface. Thus, the substream can be considered to be transferred intact onto the rod-forming surface or onto tobacco already positioned on the surface. The intactly-transferred substreams are place one on another to form the filler rod. Typically, suction is applied to the underside of the rod-forming surface to hold the filler rod thereto.

It has been found that the filler rods provided by the procedure of the invention have improved uniformity of quantity of tobacco along its length. This results directly from the formation of the plurality of substreams from the relatively wide stream since the tobacco particles of the relatively wide stream all are captured under close control by the suction and are provided with the required impetus to change direction from the relatively-wide vertically-moving stream to the narrow filler rod moving generally horizontally. The loss of control experienced in the prior art when the relatively wide stream is fed directly onto the transversely-moving rod-forming surface is eliminated and hence the lack of uniformity introduced thereby is minimized.

Since the uniformity of the weight of tobacco in the filler rod is improved by the procedure of the present invention, the necessity for overfeeding of the relatively wide stream is decreased and the quantity of tobacco required to be trimmed similarly is decreased. Hence, the filler rod-making procedure is considerably improved in runability through minimizing of chokes caused in the prior art by overfeeding. Additionally, since less tobacco needs to be trimmed, less damage to the filling power of the tobacco is experienced.

Further, the classification problem of the prior art procedure noted above is eliminated. Each substream is thin and hence classification of the sizes of the tobacco particles is minimal. In any event, the layering of the substreams to form the filler rod averages out any classification in the individual substreams and hence the filler rod has a substantially uniform particle size distribution in its cross-section.

It was surprisingly found that a filler rod formed by the procedure of the present invention exhibited a greater filling power than was attributable to the decreased trimming. This result leads to more economic tobacco utilization.

While the applicant cannot fully explain the latter unexcepted phenomenon of increased filler power, it is thought to be due, at least in part, to the fact that the filler rod is formed of discrete layers of tobacco between which there is little or no mixing. Thus, the tendency for a substantial open or space area in the interfaces between the layers leads to a greater volume of air spaces in the filler rod than conventionally is the case, leading consequently to improved filling power.

The filler rod-forming procedure of the present invention, therefore, results in a filler rod which can be produced at speed and which has several improved characteristics, including improved uniformity of quantity of tobacco along its length, a substantially uniform distribution of tobacco particle sizes and an improved filling power.

In a preferred embodiment of the invention, the filler rod is formed and conveyed under the influence of vacuum from the former to the cigarette wrapping station on a substantially flat conveyor having confining side walls which define a substantially constant width from the former to the wrapping station and which move at substantially the same speed as the surface supporting tobacco filler rod, and hence at substantially the same speed as the filler rod.

Thus, in this preferred embodiment, the relative movement between the filler rod and the sidewalls which define the lateral width of the filler rod and the decreasing of the width of the filler rod for feed to the wrapping station which occur in the prior art procedures are eliminated. By operating in accordance with this preferred embodiment, therefore, the prior art problems of introduction of lack of weight uniformity and runability associated with frictional contact between stationary confining walls and the moving filler rod are eliminated.

Additionally, since there is complete control of the movement of the tobacco particles from the relatively wide stream to the filler rod as a result of the initial formation of substreams, in a particularly preferred embodiment, the filler rod is assembled with a width less than 10 mm, typically from about 5 to 10 mm, particularly about 8.5 mm, for feed to the wrapping station without further manipulation. As a further result of this assembly procedure, it is possible for the first time to provide a narrow filler rod of dimensions for feed to the wrapping station at a high speed, typically in excess of 4,000 cigarettes per minute.

DESCRIPTION AND OPERATION OF PREFERRED EMBODIMENTS

Figure 1:
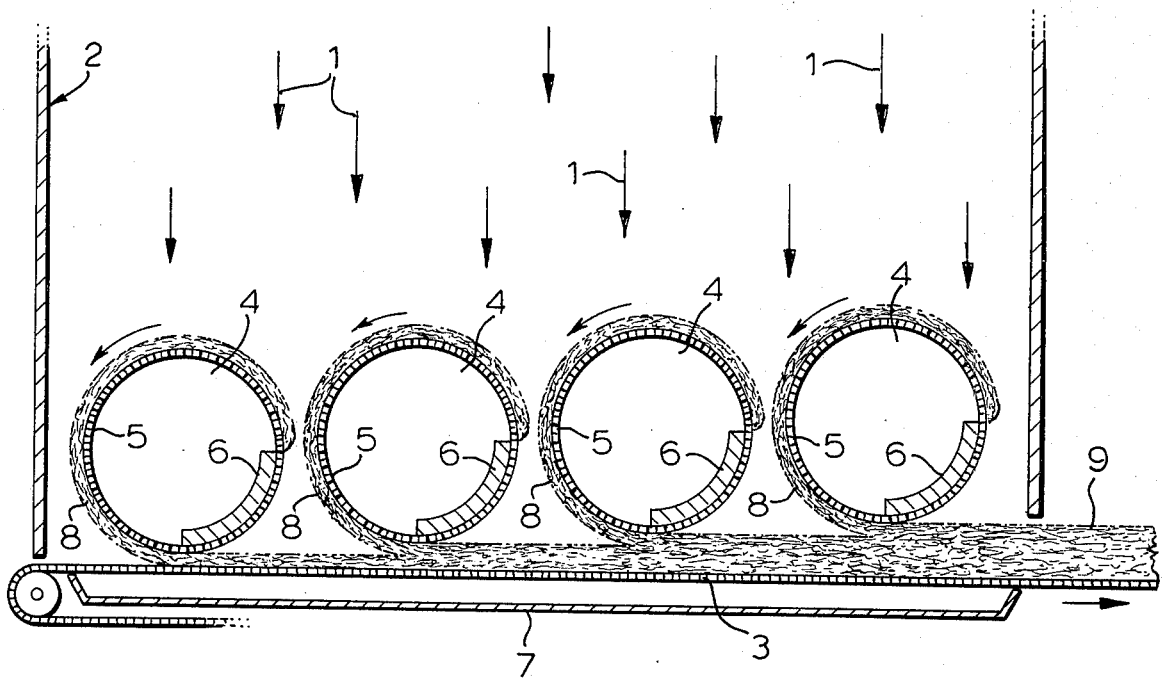
FIG. 1 is a schematic representation of a filler rod-forming procedure in accordance with one embodiment of the invention.

Referring first to the embodiment of FIG. 1, a relatively wide and thin stream of tobacco particles of varying particle sizes 1 formed in any convenient manner, falls under the influence of gravity and/or air flow in the confines of a chute 2 towards an air-permeable and tobacco-impermeable generally flat conveyor 3 the top surface of which constitutes a filler rod-forming surface or zone. As illustrated, the conveyor 3 is positioned to move substantially transverse to the direction of motion of the relatively wide stream 1 of tobacco particles. The conveyor belt 1 typically may move at a speed substantially in excess of the speed of the falling particles.

The falling stream 1 may be provided in any convenient manner, and generally has uniform quantity of tobacco across its width. For example, a shower of tobacco particles may be sprayed onto the top surface of a conveyor belt to form on the belt a wide band of tobacco particles. This wide band is conveyed on the belt to the end thereof, at which point the particles fall off the conveyor and form the falling stream or curtain 1.

A plurality of control wheels or disc members is arranged substantially across the width of the chute 2, is positioned in the path of the relatively wide stream 1 and adjacent the rod-forming surface of the conveyor 3. While four such disc members 4 are illustrated, this is for convenience of illustration and the numbers thereof may be varied. The disc members 4 are positioned in a single plane to rotate at substantially the same speed in an anti-clockwise direction on horizontal axes which are parallel to each other and perpendicular to a plane of movement of the relatively wide stream 1.

Each disc member 4 has substantially the same diameter and is typically in the form of a hollow cylinder having an air-permeable and tobacco-impermeable peripheral surface 5 which constitutes a narrow substream-forming and -conveying surface. The disc members 4 each is rotated at a speed such that the rotational speed of the peripheral surface 5 is substantially the same as the linear speed of the filler rod-forming surface 3. The interior of each disc member is maintained under a subatmospheric pressure to apply suction through the peripheral surface 5, such as by the application of a vacuum to the interior of the disc members, such as by suitable vacuum header pipes.

Inside each of the disc members 4 and located adjacent the inner surface of the peripheral surface 5 is a non-porous fixed shield or shoe 6. The shoe 6 may be constructed in any convenient manner so that the suction is released over those portions of the peripheral surface 5 adjacent thereto at any given time. The shields 6 typically prevent the vacuum from acting over the area of the peripheral surface 5 which is located from approximately the point of nearest approach of the wheel to the top surface of the conveyor 3 through about 90° in the direction of movement of the disc member 4.

Each of the disc members 4 may be constructed as described below in connection with disc members 16 illustrated in the embodiment of FIGS. 2 to 11. Alternatively, the disc members 4 may be constructed as described in U.S. Pat. No. 3,779,252.

A suction box 7 is positioned adjacent the underside of the filler rod-forming surface 3 for the application of suction therethrough to the tobacco particles on the rod-forming surface 3. The suction box 7 may extend beyond the lateral width of chute 2, if desired, to assist in conveying the filler rod. While it is preferred to use such a suction box 7 in common with the prior art, as discussed above, it may be omitted, if desired.

The surface length over which the tobacco particles are captured on the peripheral surfaces 5 is $\pi/2$ times greater than the width of the relatively wide stream 1, thereby increasing the effectiveness of vacuum utilization.

In the operation of the embodiment of FIG. 1, as the falling particles in the stream 1 approach the disc members 3, they are attached by the suction acting across the peripheral surface 5 and arrested on and gripped to the peripheral surface 5 by the suction induced friction. A narrow and thin substream of tobacco particles 8 is built up on the portion of each of the peripheral surfaces 5 facing the tobacco particles in the stream while the disc members 4 rotate anti-clockwise, the narrow substream having an increasing depth in its direction of movement. Each of the narrow substreams 8 contains substantially the same quantity of tobacco. Since the plurality of substreams 8 formed on the peripheral surfaces 5 are relatively thin, the tobacco particles therein are readily maintained under the influence of the suction applied across the peripheral surfaces 5, so that no balling-up of tobacco particles occurs.

Further, since the maximum thickness of the substream 8 is still relatively thin, there is a minimal classification of tobacco particle sizes in the substream 8.

Capturing of the tobacco particles from the relatively wide stream and rapidly bringing them under control on the peripheral surface 5 imparts to the tobacco particles the speed of the peripheral surface 5 and hence substantially the speed of the rod-forming conveyor 3.

Each substream 8 is moved out of contact with the tobacco particles of the stream 1 at its maximum thickness and by motion of the peripheral surface 5 and still under the influence of the suction until the leading particles of the narrow substream 8 reach the vacuum shoe 6. At this point, the leading tobacco particles of each of the substreams 8 are moving in the same direction as the filler rod-forming surface 3, are moving at substantially the same speed as the filler rod-forming surface 3 and adjacent to the filler rod-forming surface 3. By the action of the vacuum shoe 6, the suction no longer is applied across the peripheral surface 5 and hence the leading tobacco particles of the substream 8 no longer are held to the surface 5 and therefore the leading particles of the substream 8 are transferred from the peripheral surface 5 onto the filler rod-forming surface of the conveyor 3 in the case of the left-hand most disc member 4 and onto the partially-formed filler rod in the case of the other disc members 4.

The disc members 4 are positioned sufficiently close to the rod-forming surface 3 that the tobacco particles in the substream 5 are not separated from one another but rather retain the relative positions one to another when positioned on the conveyor 3 as existed in the substream 5 immediately prior to release from the suction grip of the disc members 4. In effect, the substream 5 from each disc member 4 is laid gently on the rod-forming surface 3 or on a partially-formed rod, as the case may be, so that a filler rod 9 is formed by the positioning of the layers of tobacco one on top of another across the width of the chute 2. Since the filler rod 9 is formed by this gentle intact layering procedure, little or not disturbance of the coherent form of each substream occurs and there is a substantial absence of intermixing of tobacco particles from one layer to the next.

The tobacco particles in the layers of tobacco on the rod-forming surface 3 are substantially tangential to the peripheral surface 5 at the point of release of the tobacco particles from the peripheral surface 5.

Due to the control of the velocity of the approach of the tobacco particles from the falling relatively wide stream 1 to the rod-forming conveyor 3 by the formation of the substreams 8 and assembly of the filler rod 9 therefrom, and thereby control of the effectively right-angle movement of the tobacco particles of the relatively wide stream 1 to the filler rod 9, number of improvements result.

Thus, the tendency of the particles to form peaks and valleys in the filler rod is considerably diminished, so that, as compared to a conventionally-formed filler rod, the present invention provides a tobacco filler rod having a more uniform distribution of quantity of tobacco along its length, leading to a diminished trimming requirement.

For example, there is no penetration between the tobacco particles of one narrow substream 8 as it is positioned on another as the filler rod 9 is built up on the conveyor 3. As compared to a tobacco stream formed in conventional manner from a relatively wide stream, there is thereby provided a tobacco rod 9 having a more uniform distribution of tobacco particle sizes over its cross section.

As the narrow substreams 8 are formed on the porous surfaces 5 of the disc members 4, a minor degree of classification and peak-and-valley formation may occur on each wheel. Since a plurality of such substreams 8 is formed and the filler rod 9 is formed by layering of the substreams, the effect is cancelled out.

Further, the filler rod 9 exhibits a filling power greater than a conventionally-formed filler rod and greater than that attributable to decreased trimming requirement, hence allowing a more economic tobacco utilization. The filler rod 9, therefore, has considerable improvements as compared with the filler rods obtained by the conventional means discussed above.

Figure 2:
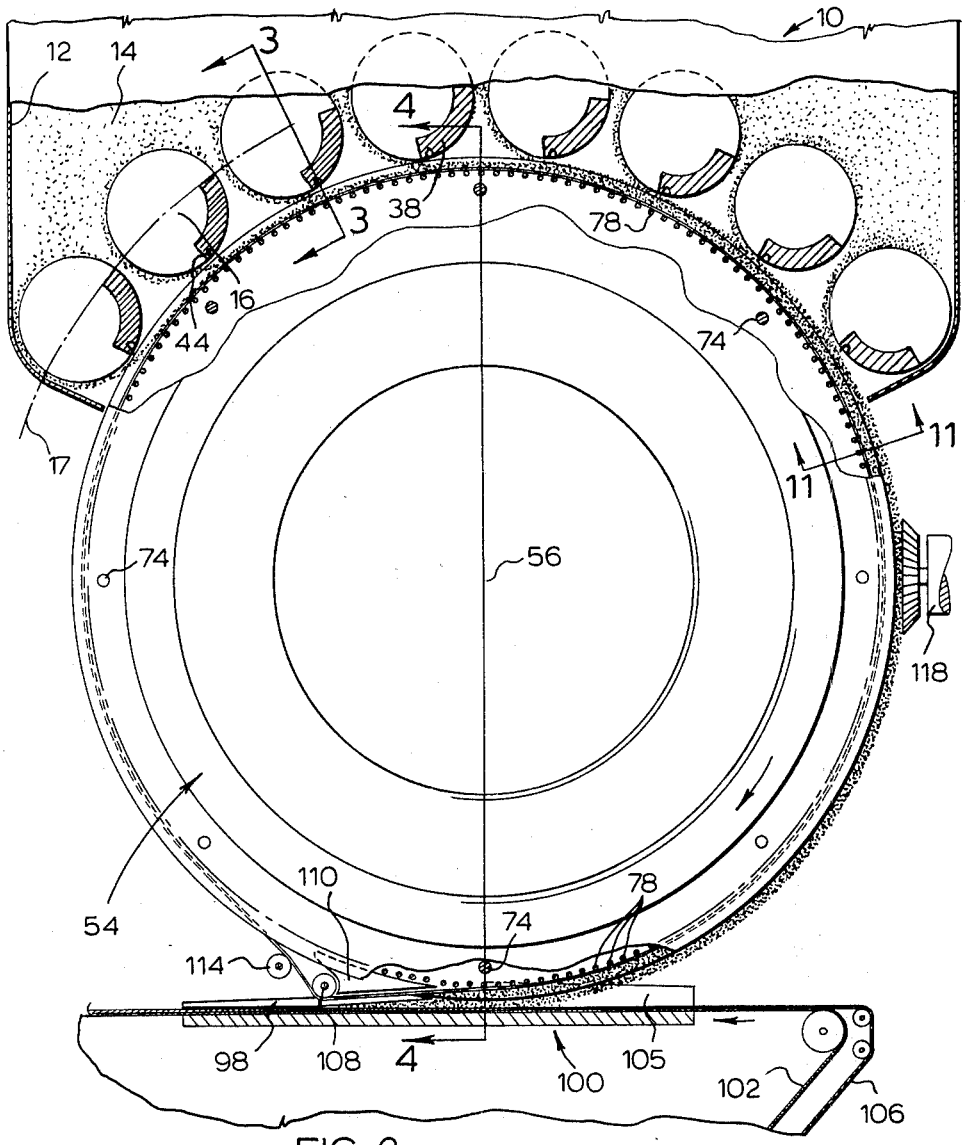
FIG. 2 is a schematic front elevational representation of a cigarette making machine for forming cigarettes in accordance with a second embodiment of the invention.
Figure 11:
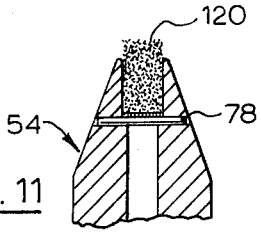
FIG. 11 is a sectional view taken on line 11—11 of FIG. 2.
Figure 3:
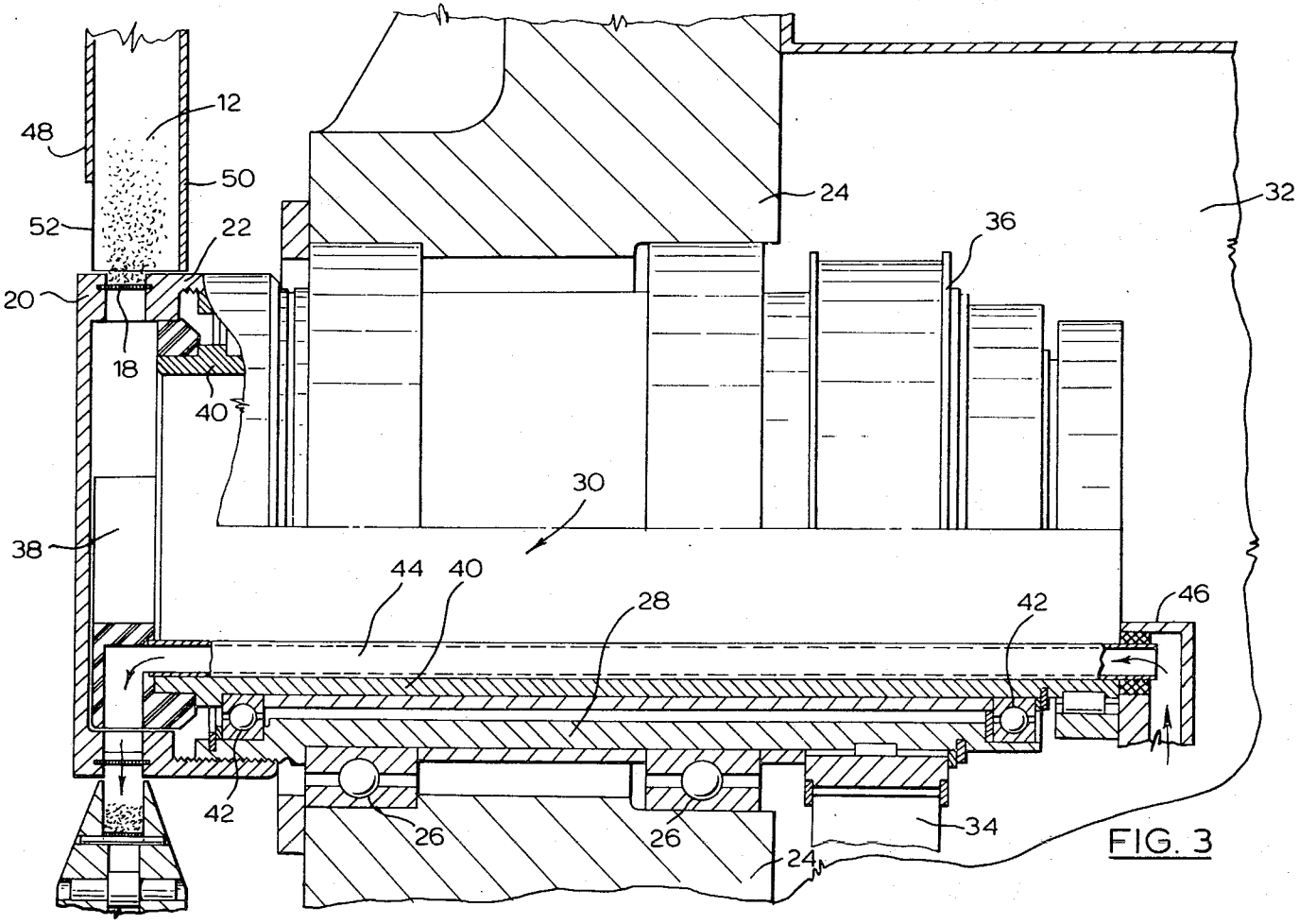
FIG. 3 is a sectional view taken on line 3—3 of FIG. 2.

Turning now to consideration of the embodiment of FIGS. 2 and 11, a cigarette making machine 10 for use in the present invention includes a chute 12 of broad width and thin thickness for confining a falling broad stream 14 of substantially separated tobacco particles having a substantially uniform weight distribution across its width. Located towards the lower end of the chute 12 are a plurality of vacuum wheels 16, each of substantially the same diameter, arranged substantially with their rotational axes on the arc of a circle 17 and substantially perpendicular to the flow path of the broad stream 14. While eight such vacuum wheels 16 are illustrated, this is a preferred number and the invention is not limited thereto.

Each of the vacuum wheels 16 includes (see FIG. 3) a recessed air-permeable and tobacco-impermeable peripheral surface 18 supported between a front circular closure element 20 and a rear annular element 22.

Each of the wheels 16 is mounted to a stationary frame member 24 for rotation with respect thereto about the axis of the wheel 16 with the peripheral surface 18 in the flow path of the broad stream 14. Bearings 26 are provided between the stationary frame member 24 and a hub 28 of the wheel 16.

The hub 28 includes a passage 30 communicating at one end with an enclosed space 32 having a subatmospheric pressure achieved by connection to a source of vacuum. Typically, one enclosed space 32 is provided common to all the wheels 16 and connected to a single source of vacuum.

At the other end, the passage 30 communicates with the underside of the peripheral surface 18, so that the subatmospheric pressure in the enclosed space 32 induces suction across the peripheral surface 18.

A drive belt 34 engages an outer portion 36 of the hub 28 to impart rotative motion to the wheel 16. As may be seen in FIG. 10 and as described in more detail below, the wheels 16 are driven from a common drive so that they rotate at substantially the same speed.

The passage 30 has a large diameter which is comparable to that of the peripheral surface 18. This construction allows a high flow rate of air through the passage and hence a less horsepower vacuum motor is required to produce the same suction across the peripheral surface 18 than would be the case if a lesser diameter passage 30 were used.

The suction across the peripheral surface 18 also may be provided by application of subatmospheric pressure through the closure member 20, with omission of the passage 30, as shown in U.S. Pat. No. 3,779,252. However, this structure is less preferred since a vacuum seal is required between rotating and stationary members and equipment is required on both sides of the peripheral surface 18, introducing possible servicing problems. It is preferred, therefore, to utilize the illustrated structure, wherein no vacuum seal is required and the vacuum producing equipment and the drive mechanism are provided on the same side of the peripheral surface 18.

A vacuum shoe 38 is provided internally of the wheel 16 and arranged to prevent the application of suction over a selected arcuate length of the peripheral surface 18. The vacuum shoe 38 forms an integral part of a stationary cylindrical member 40 defining the walls of the passage 30 and about which the hub 28 may revolve on bearings 42.

A bore 44 is formed in the cylindrical member 40 along the length thereof and terminating at one end adjacent the peripheral surface 18 and at the other end in an enclosure 46 isolating the end of the bore 44 from the enclosed space 32. The enclosure 46 is adapted to be connected to a source of compressed air for the application of air pressure across the peripheral surface 18 adjacent the one end of the bore 44.

The chute 12 has substantially parallel and vertical front and rear walls 48, 50 at least over a substantial length thereof towards the wheels 16. One or more of the front and rear walls 48, 50 of the chute 12 may taper towards the wheels 16. The chute walls 48 and 50 are oriented so that the rear wall 50 extends downwardly substantially to the annular member 22 of the wheel 16 at a location remote from the peripheral surface 18.

The front wall 48 extends downwardly in alignment with the edge of the front closure 20 adjacent the peripheral surface 18 and terminates a vertical distance from the front closure 20 so that there is a gap 52 between the lower edge of the front wall 48 and the front closure 20 thereby opening the chute 12 to atmosphere so that air drawn through the peripheral surfaces 18 by the internal suction applied to the wheels 16 is drawn through the gap 52 as well as from the chute 12 at least in the region of substream formation on the peripheral surface 18.

By using this arrangement, vacuum only is used to form substreams from the broad or relatively wide and thin stream of tobacco particles as described in more detail below and additional guides may be omitted.

However, cams adjacent the periphery of the annular member 22 and/or the front closure 20 may be used, if desired, to force errant tobacco particles onto the peripheral surface 18.

The arcuately-arranged vacuum wheels 16 are positioned adjacent the periphery of a large vacuum wheel 54 mounted for rotation on a horizontal axis 56 which is parallel to the axes of rotation of the vacuum wheels 16. Typically, the arc 18 on which the majority of the axes of the vacuum wheels 16 are located is concentric with the axis of rotation of the large vacuum wheel 54. Ideally, the points of closest approach of the wheels 16 to the large wheel 54 should be as close as possible to attempt to get a "tangential transfer" of substreams of tobacco from the wheel 16 to the wheel 54, as explained in more detail below. Also, it is desired to have the filler rod formed on the large wheel 54 extend above the outer periphery of the wheel 54. To compromise these design desirables, the six left-hand most wheels 16 have their axes located on the arc 17 while those at the right-hand end of the arc of wheels have their axes spaced upwardly from the arc 17 an increasing but small distance towards the right-hand end.

The large vacuum wheel 54 is mounted for rotation on its axis relative to a stationary frame member 58 which may be integral with the stationary frame member 24 relative to which the vacuum wheels 16 rotate.

Bearings 60 are provided between the stationary frame member 58 and a hollow hub 62 to allow respective rotative movement. A drive belt 64 engages an outer portion 66 of the hub 62 to impart the rotative motion to the large vacuum wheel 54.

Figure 10:
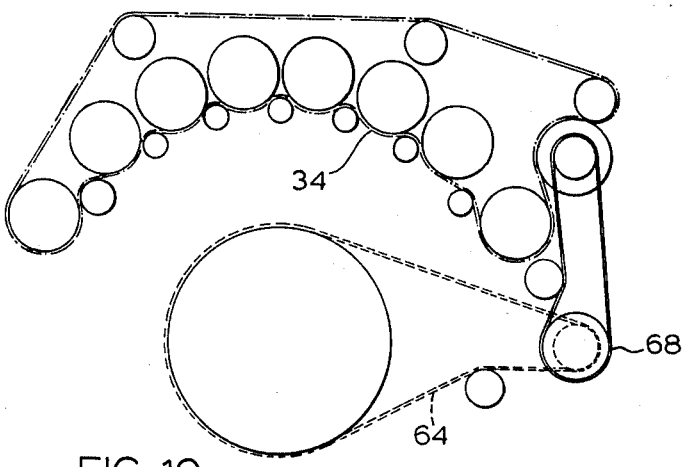
FIG. 10 is a schematic rear view of the cigarette making machine of FIG. 2 showing the drive mechanism for the apparatus.

As seen in FIG. 10 a single drive motor 68 drives the large vacuum wheel 54 and the vacuum wheels 16 through drive belt 64 associated with the large vacuum wheel 54 and a common drive belt 34 associated with the vacuum wheels 16. The motor 68 also typically drives other drivable members of the machine 10, such as the wrapper device feed and the tobacco feeder to the chute 12, so that each member of the machine 10 is driven at preset speed differentials with each other from a single drive motor 68. Appropriate gearing, typically in the form of timing pulleys are different diameters, is used to provide a peripheral speed of the large vacuum wheel 54 which is substantially that of each of the vacuum wheels 16.

Figure 4:
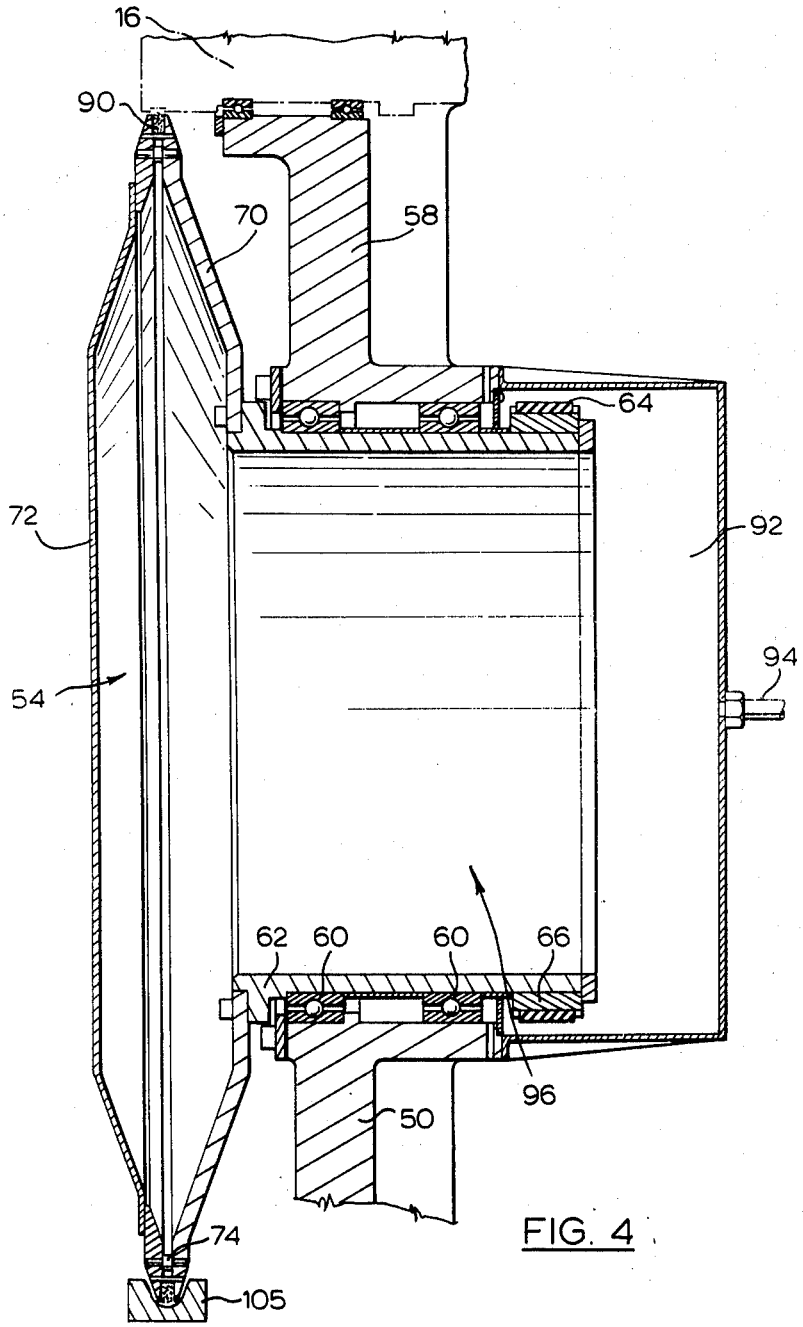
FIG. 4 is a sectional view taken on line 4—4 of FIG. 2.
Figure 5:
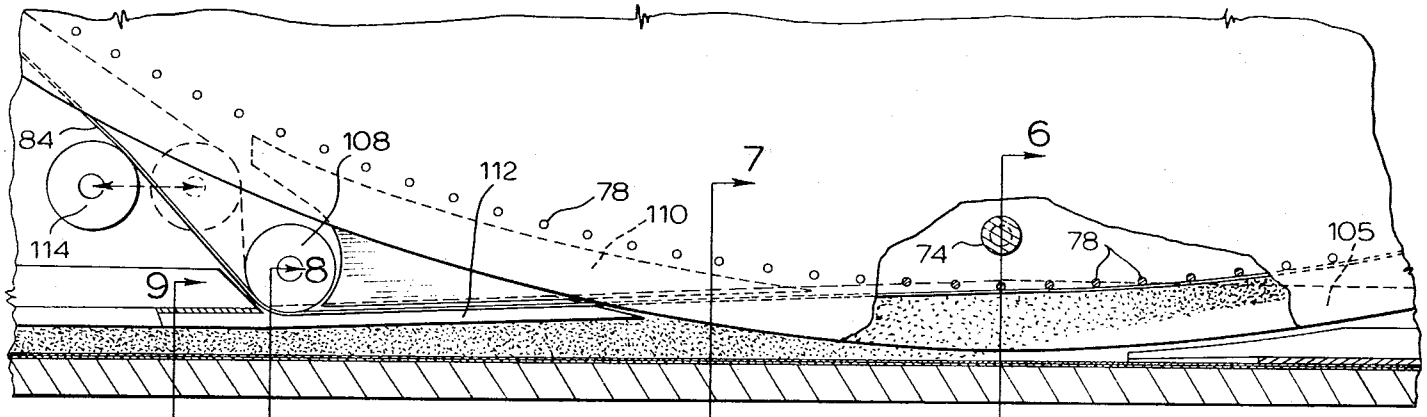
FIG. 5 is a close-up of the portion of the machine adjacent the filler rod wrapper.

Reverting to FIG. 4, connected to the hub 62 is a dished annular flange member 70 which is joined to a circular front closure 72 of diameter substantially that of flange member 70. The flange member 70 is joined to and spaced from the front closure 72 in any convenient manner, such as, by a plurality of pins 74 positioned in inteference fit with both the flange member 70 and the front closure 72 and having a central spacer element 76 maintaining the flange member 70 and the front closure 72 a predetermined distance apart.

Located closer to the periphery of the wheel 54 than the joining pins 74 and extending between the flange member 70 and the front closure 72 are a plurality of circumferentially-adjacent pins 78 substantially equally spaced from each other. These pins 78 define with continuous shoulders 80 and 82 provided in the flange member 70 and the front closure 72, respectively, a peripheral support for an endless air-permeable tobacco-impermeable flexible band 84, which is positioned in engagement with the shoulders 80 and 82 and pins 78 over substantially the whole periphery of the wheel 54. Intermediate support members other than the pins 78 may be provided, if desired. Any desired alternative manner of providing a supported air-permeable and tobacco-impermeable band between the flange member 70 and the front closure 72 may be used.

The flexible band 84 defines with the adjacent walls 86 and 88 of the flange member 70 and the front closure 72 respectively a peripheral tobacco-receiving and -conveying groove 90.

An enclosure 92 in communication with a source of vacuum, such as by vacuum header pipe 94 is under a subatmospheric pressure which causes suction across the band 84 through the fluid flow relationship between the enclosure 92 and the band 84 established by the central bore 96 in the hub 62.

Located on the diametrically opposite side of the large vacuum wheel 54 from the vacuum wheels 16 is a cigarette filler rod wrapper device 98 and feed mechanism 100 therefor of typically conventional construction. As seen in more detail in FIGS. 5 to 9, the feed mechanism 100 includes a belt 102 moving substantially horizontally in a trough 104 formed in a stationary block 105 towards the left as seen in the drawings and cigarette wrapping paper 106 positioned in engagement with the belt 102 and moving therewith into the throat of the wrapper device 98. The stationary trough 104 decreases in dimension towards the tongue 107 of the wrapper device 98, as may be seen from the cross-sectional views of FIGS. 6 to 9.

Figure 6:
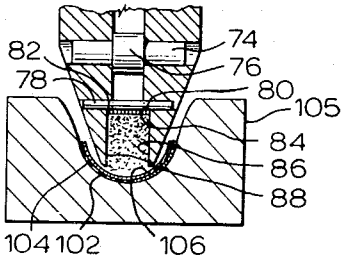
FIG. 6 is a sectional view taken on line 6—6 of FIG. 5.
Figure 7:
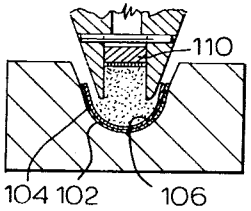
FIG. 7 is a sectional view taken on line 7—7 of FIG. 5.
Figure 8:
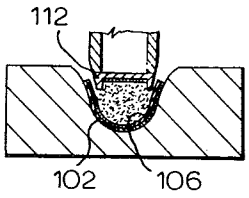
FIG. 8 is a sectional view taken on line 8—8 of FIG. 5.
Figure 9:
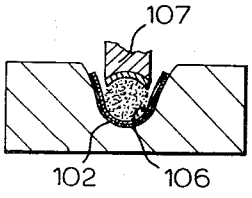
FIG. 9 is a sectional view taken on line 9—9 of FIG. 5.

As may be seen from the cross-sectional of FIG. 6, when the large wheel 54 is closest to the trough 104, the members 70 and 72 extend into the trough almost to the point of touching the paper 106. In view of the conventional dimensions of the trough 104, the radially outer portions of the members 70 and 72 are tapered as illustrated.

A roller 108 is positioned adjacent the tongue 107 of the wrapper device 98 and receives the belt 84 therearound so that in the region of the feed mechanism 100 from the point of nearest approach of the large wheel 54 to the throat 107, the belt 84 leaves contact with the pins 78 at approximately the point of nearest approach of the wheel 54 to the trough 104 and extends in the direction of movement of the belt 102 and converges therewith to the roller 108, the belt 84 being guided first by an upper stationary guide 110 which includes an integrally-formed depending side wall 112 over the latter portion of this travel.

The belt 84 passes in contact with roller 108 and a second roller 114 which may be mounted for adjustable movement to tension properly the belt 84 and then back into contact with the peripheral pins 78 of the wheel 54.

The stationary guide 110 also provides a vacuum shoe adjacent the outer periphery of the wheel 54 in the zone thereof adjacent the movement of the belt 84 from the wheel 54 to the roller 108.

A further vacuum shoe, typically external (not shown), may be provided adjacent the belt 84 from its recontact with the pins 78 to the left most vacuum wheel 16 to prevent application of suction across the belt 84 in this region.

A compressed air jet, or the like, may be provided adjacent the undersurface of the belt 84 between the rollers 108 and 114 for the application of compressed air to the belt 84 for cleaning thereof by removal of tobacco debris from the outer surface thereof.

A trimmer device 118 of any convenient construction may be provided adjacent the periphery of the wheel 54 between the vacuum wheels 16 and the feed mechanism 110 to trim tobacco from a filler rod conveyed by the large wheel 54.

The peripheral surface 18 and the belt surface 84 preferably are dimensioned less than 10 mm wide, typically about 5 to 10 mm, more particularly about 8.5 mm. The provision of the vacuum wheels 16 in the apparatus 10 permits the formation of a filler rod 120 of this width dimension at high speeds of 4,000 cigarettes per minute or greater.

The operation of the preferred embodiment of the invention illustrated in FIGS. 2 to 11 in forming the filler rod 120 is very similar to that involved in the embodiment of FIG. 1. Thus, the tobacco particles of the falling stream 14 are attracted to and captured by the outer surface of the peripheral surface 18 of each vacuum wheel 16 by the action of the suction applied across the surface 18.

On each peripheral surface 18, there is formed an elongated thin and narrow substream of tobacco composed of the attracted and captured tobacco particles.

The substream formed on each surface 18 is conveyed under the influence of the suction to a discharge point which is the point at which the leading tobacco particles of the substream are adjacent to and moving in the same direction and speed as the belt 84. This location corresponds, with the vacuum wheels 16 rotating in anti-clockwise direction and the large wheel 54 rotating in a clockwise direction, to the location of the upstream arcuate end of the vacuum shoe 38.

The tobacco particles of the substream are released from the action of the suction across the peripheral surface 18 by the vacuum shoe 38 and the particles tend to lose contact with the surface 18 and this loss of contact is enhanced by the pressure of air blowing through the bore 44.

The tobacco particles released in this way then come under the influence of the suction applied across the surface of the band 84 so that the tobacco particles are captured and held by that suction.

For the left-most vacuum wheel 16 in FIG. 2, the tobacco particles released from the surface 18 of the wheels 16 are positioned on the belt 84. For the remainder of the vacuum wheels 16, the released particles are deposited on a layer of tobacco. In this way, a tobacco filler rod of the required thickness is built up on the belt 84 in its arcuate movement from the left-handmost wheel 16 to the right-handmost wheel 16.

The distance between the wheels 16 and the belt 82 or the partially-formed filler rod stream, whichever is the case, is such that the released tobacco particles substantially retain the same relative locations with respect to each other during transfer from the wheel 16 to the wheel 54. Thus, the coherent form of the conveyed substream is retained on the belt 84.

As mentioned above, the positioning of the peripheral surfaces 18 and the belt 84 is a compromise of the ideal arrangement. Ideally, the tobacco particles of each substream are tansferred directly and intactly from the peripheral surface 18 to the belt 84 or onto tobacco thereon by tangential transfer, i.e. the substream particles at the point of release from the peripheral surface 18 and at the substantially simultaneous point of engagement with the belt 84 or tobacco thereon, as the case may be, lie on a line which is tangential to the surfaces.

However, such tangential transfer is possible only with a few of the right-hand wheels 16. For the remainder of the wheels 16, while the transfer is not absolutely tangential, nevertheless the tobacco particles released from the peripheral surfaces 18 substantially retain the same relative locations with respect to one another during the transfer, so that in each case the transfer of the substream from the surface 18 to the belt 84 may be considered to be substantially intact.

The filler rod 120 formed in this way may be considered to be formed by the layering of successive substreams one on top of another to form the filler rod of the required dimension. The filler rod 120 typically has about 20% of its depth situated above the level of the outer periphery of the members 70, 72, although any desired proportion may be so situated.

Since the walls 86 and 88 adjacent the belt 84 move at the same speed as the belt 84, in contrast to the prior art procedure of formation of a filler rod on a moving surface between stationary side walls, the side wall friction problem, mentioned above, is avoided.

Additionally, the peripheral surface 18 and the belt 84 are dimensioned so that their width corresponds to the width of filler rod desired to be fed to the wrapping device 98 and this dimension is retained substantially constant to the wrapper feed device 100. This again is in contrast to the prior art and avoids the prior art side wall friction problem occasioned by narrowing of the width of the filler rod after formation thereof for feed to the wrapper feed device.

Assembly of the filler rod 120 by the layering of substreams of tobacco in accordance with this procedure results in a filler rod having improved characteristics as compared to a filler rod stream formed by conventional procedures as discussed in more detail above in connection with the formation of the filler rod 9 in the embodiment of FIG. 1.

The filler rod 120 formed in this embodiment then is conveyed under the influence of vacuum on the belt 84 past a trimmer 118 at which point excess tobacco may be removed to improve further the uniformity of the quantity of tobacco in the filler rod. The quantity of tobacco trimmed generally is below about 15% of the quantity of tobacco in the filler rod 120 and typically is about 12%.

The trimmed filler rod is conveyed on the belt 84 to the wrapper feed mechanism 100. As mentioned previously, in conventional cigarette making machines, the filler rod is conveyed from its formation to the wrapper feed mechanism between stationary side walls. Since the side walls adjacent the filler rod conveyed on the belt 84 move at the same speed thereas, this side wall friction problem of the prior art is avoided.

As may be seen from FIGS. 5 to 9, as the belt 84 leaves engagement with the pins 78 at the approximate point of nearest approach of the wheel 54, the wrapper feed mechanism 100 and the vacuum is released, the filler rod is tranferred to the paper 106 and is fed into wrapper 98 thereon, contact between the belt 84 and the filler rod being terminated at the roller 108.

The natural tendency for the filler rod 120 is spread into the trough 104 upon removal of the lateral confining walls 86 and 88 and the suction hold is minimized by the usual high speed of operation of the apparatus.

The embodiment of FIGS. 2 to 11 therefore provides a superior rod-forming and -conveying system with good runability suitable for the high speed formation of cigarettes of superior weight uniformity and particle size distribution which forms and conveys the filler rod at the narrow width required by the conventional wrapping means under the control of moving side walls. In addition, the increased filling power of the filler rod arising from the manner of assembly of the rod and the decreased trimming requirement decreases the quantity of tobacco required to provide a predetermined cigarette hardness, thereby resulting in more economic tobacco utilization.

DESCRIPTION AND OPERATION OF ALTERNATIVE EMBODIMENTS

Figure 12:
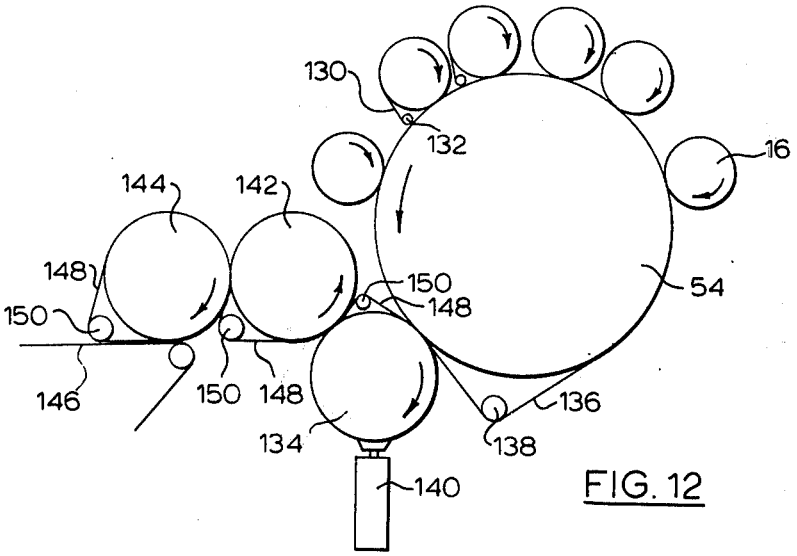
FIG. 12 is a schematic elevational representation of a cigarette making machine for forming cigarettes in accordance with a third embodiment of the invention.
Figure 13:
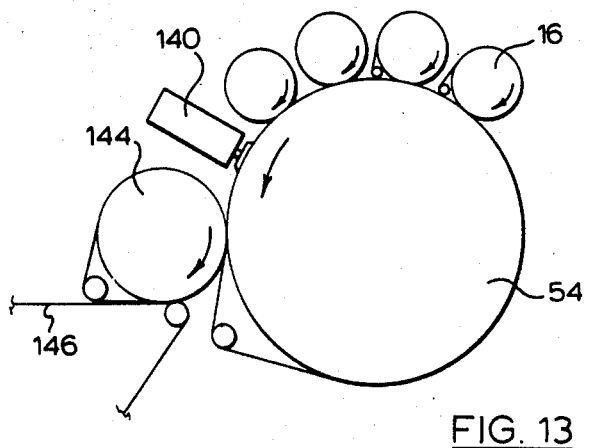
FIG. 13 is a schematic elevational representation of a cigarette making machine for forming cigarettes in accordance with a fourth embodiment of the invention.
Figure 14:
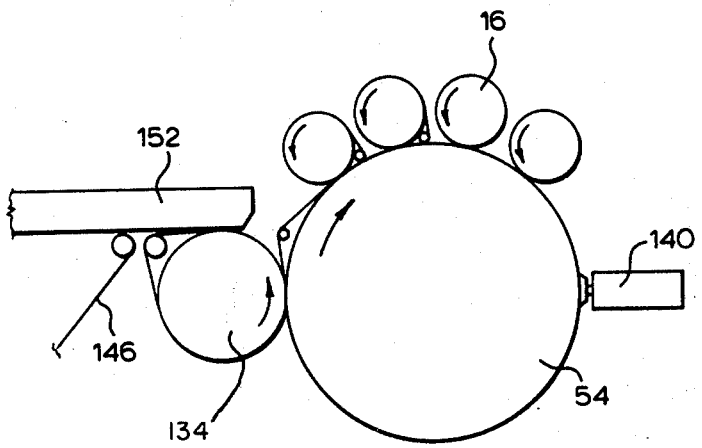
FIG. 14 is a schematic elevational representation of a cigarette making machine for forming cigarettes in accordance with a fifth embodiment of the invention.

Referring now to the alternative structures of the embodiments of FIGS. 12 to 14, there are illustrated similar filler rod-forming and -conveying procedures to that of the embodiment of FIGS. 2 and 11, using small substream-forming vacuum wheels and a large conveying wheel in analogous manner to wheels 16 and 54 in the embodiment of FIGS. 2 and 22. These embodiments, however, also illustrate possible modifications to the vacuum wheel 16 and the disc members 4 structure and conveying systems for transfer of the filler rod to the wrapper feed where the latter is not located immediately below the wheel 54 as in the embodiment of FIGS. 2 to 11.

In FIG. 12, the wheels 16 and wheel 54 rotate in the opposite direction to their direction of rotation in the embodiment of FIGS. 2 to 11, and an air-permeable tobacco-impermeable endless ribbon or tape 130 is supported in the peripheral groove of the wheel 16 to constitute the forming and conveying surface for the substream in place of the peripheral surface 18. At the point of closest approach of each wheel 16 to the periphery of the wheel 54 and corresponding to the point of commencement of the vacuum shoe which extends arcuately in the direction of rotation of the wheel 16, the ribbon 130 loses contact with the foraminous surface and extends away from the periphery of the wheel 16, generally tangentially to the foraminous surface and tangentially to the outer periphery of the wheel 54, and passes round a suitably supported idler roller 132 before coming into contact again with the supporting surface of the wheel 16. By providing the ribbon 130 in this way, release of the substreams from the wheels 16 onto the periphery of the wheel 54 is assisted, and the necessity for a positive blow-off of the substream from the foraminous surface, as described in connection with the embodiment of FIGS. 2 to 11 may be avoided.

A rotatable wheel 134 is provided adjacent the periphery of the wheel 54 at the commencement of the vacuum shoe of the wheel 54 to receive the filler rod from the foraminous surface of the wheel 54 onto the periphery of the wheel 134 and for rotation in a clockwise direction. A continuous air-permeable tobacco-impermeable ribbon 136 may be provided in contact with the supporting surface of the wheel 54 over the majority of the arcuate length thereof, in analogous manner to band 84 in FIGS. 2 to 11. Where such a ribbon 136 is employed, it extends away from the wheel 54, usually substantially tangentially to the outer periphery of wheel 134 and tangentially to the foraminous surface of wheel 54 at the point of closest approach of wheels 54 and 134 to each other, and passes around roller 138. The provision of a ribbon in this manner assists in the transfer of the filler rod from the wheel 54 to the wheel 134, although in this embodiment it may be omitted, if desired.

The wheel 134 is constructed in analogous manner to wheels 16, and, reference is made to the description of the construction of the wheels 16 above, the basic difference lying in the relative diameters. The wheel 34 therefore possesses an air-permeable and tobacco-impermeable recessed conveying surface through which air flow is induced by an internal vacuum and which has substantially the same width as the channels of the wheels 16 and the wheel 54 for the reasons discussed in detail above in connection with the embodiment of FIGS. 2 to 11. While the diameters of wheels 16 and 134 are illustrated to be different, this is a matter of choice and convenience.

A trimmer 140 of any convenient construction may be provided adjacent the periphery of wheel 134 to trim tobacco from the filler rod as desired. By trimming tobacco on wheel 134, the side of the filler rod which was sitting on the foraminous surface of the wheel 54 is trimmed. If desired, however, trimming of the other side of the rod may be carried out on the wheel 54, in similar manner to that described above in connection with the embodiment of FIGS. 2 to 11.

While the trimmer 140 is illustrated as being located adjacent the periphery of wheel 134, this arrangement is not essential, and the trimmer may be positioned at any other convenient location between the formation of the rod and the wrapping station.

Two further rotatable wheels 142 and 144 are provided between the wheel 134 and the entrance to the wrapping station of conventional construction, the paper feed 146 only being illustrated.

The wheels 142 and 144 are the same as wheel 134 and allow the transfer and vacuum conveying of the filter rod from the wheel 134 to the paper feed 146. Air-permeable and tobacco-impermeable ribbons 148 and free wheeling rollers 150 may be provided associated with each of wheels 134, 142 and 144 in analogous manner to the ribbon 130 and the roller 132 associated with each wheel 16 to assist in the removal of the filler rod from one peripheral groove on one wheel to another. At the discharge point fron one wheel to another, i.e. the point of closest approach and the start of the vacuum shoe on the discharge wheel, the ribbon may extend tangentially from the outer periphery of the wheel to which the filler rod is discharged and tangentially to the foraminous surface of the wheel from which the filler rod is discharged.

Two wheels 142 and 144 are illustrated in FIG. 12 having a diameter the same as each other and the same as wheel 134. However, any number of wheels, of diameters varying from each other, may be used depending primarily on the distance between the rod-forming station and the wrapping station and on the necessity of discharging the filler rod in the same direction as the movement of the paper at the wrapping station.

In FIG. 13, there is illustrated a further embodiment wherein the transfer from the wheel 54 to the paper tape fedd 146 of the filler rod is simplified as compared to the embodiment of FIG. 12, with the filler rod being transferred directly from the wheel 54 to wheel 144 from whence it is fed to the paper tape feed 146. Trimming of the rod using trimmer 140 occurs on the wheel 54 after formation thereof and prior to transfer to the wheel 144.

In the additional modification of FIG. 14, the filler road again is trimmed using trimmer 140 while transported on wheel 54. In this modification, however, the wheels 54 and 16 rotate in the opposite direction to that in FIGS. 12 and 13.

The filler rod is transferred to a single wheel 134 which feeds the rod to the paper tape feed 146 by means of a vacuum bridge 152. The use of a vacuum bridge is less preferred and its use in this embodiment may be avoided by the use of two wheel between wheel 134 and the paper tape feed 146, for example, equivalent to wheels 142 and 144 in FIG. 12, provided proper dimensioning and positioning of the various items is achieved.

SUMMARY

It will be seen, therefore, that the present invention provides improved tobacco filler rod-forming procedures. In view of the improvements in the characteristics of the tobacco filler rod formed in the present invention as compared to the rod formed by conventional means, cigarettes may be produced having a more consistent and improved quality at high speed with reliable operation.

Modifications are possible within the scope of this invention.

What we claim is:

1. A process for forming a narrow tobacco filler rod, which comprises showering a relatively wide stream of tobacco particles of narrow thickness and having a substantially uniform weight distribution of tobacco across its width onto a plurality of continuously moving arcuate suction surfaces located across the width thereof;

forming directly from said relatively wide stream a plurality of narrow substreams of tobacco each having substantially the same quantity of tobacco therein by applying suction through said surfaces to attract and grip tobacco particles to said surfaces;

changing the direction of movement of the tobacco particles forming said substreams relative to the direction of said relatively wide stream by continuously moving said surfaces, while maintaining said suction, from a position in which said surfaces contact and intercept said relatively wide stream to a position in which said surfaces are out of contact with said relatively wide stream;

moving a tobacco substream-receiving and filler rod-forming surface transverse to the width of said relatively wide stream beneath said moving surfaces;

releasing conveyed tobacco particles in said substreams from contact with said moving surfaces when said tobacco particles in said substreams are moving in substantially the same direction as and adjacent to said receiving surface and at substantially the same speed thereas;

depositing said tobacco particles immediately after said release from said moving surfaces onto said receiving surface or onto released tobacco already deposited thereon in substantially the same juxtaposition relative to one another as existed in said substreams immediately prior to said release; and removing tobacco filler rod from said receiving surface.

2. The process of claim 1 wherein said plurality of narrow substreams forming step provides substreams having a sum of individual lengths greater than said width of said relatively wide stream.

3. The process of claim 2 wherein said sum of individual lengths is about $\pi/2$ greater than the width of said relatively wide stream.

4. The process of claim 1 including applying suction through said receiving surface to said released tobacco particles deposited on said receiving surface.

5. A process for forming a narrow continuous cigarette rod from which individual cigarettes may be provided, which comprises:

showering a relatively wide stream of tobacco particles of narrow thickness and having a substantially uniform weight distribution of tobacco across its width onto a plurality of cylindrical members rotating about their axes in said flow path with the axis of each of said cylindrical members being substantially perpendicular to said flow path, providing an air-permeable and tobacco-impermeable continuous surface in at least a substantial portion of the wall of each of said cylindrical members to provide a tobacco substream-forming and conveying surface of which one portion intercepts said relatively wide stream and the remainder does not intercept said relatively wide stream, continuously applying suction through said air-permeable and tobacco-impermeable surfaces over said one portion thereof to attract and grip tobacco particles from said relatively wide stream to each of said surfaces in the length thereof momentarily intercepting said relatively wide stream to provide a plurality of narrow substreams of tobacco each having the same quantity of tobacco therein and increasing in thickness in the curvilinear direction of movement of said surfaces in said one portion thereof, continuously conveying a substream of tobacco of substantially uniform thickness on part of said remainder of each of said surfaces under the influence of suction applied through said air-permeable and tobacco-impermeable surfaces over said part of said remainder thereof, moving transverse to said flow path and adjacent said remainder of said surfaces narrow air-permeable and tobacco-impermeable rod-forming surface having a substantially flat cross section taken across the width thereof, applying suction to the undersurface of said air-permeable and tobacco-impermeable rod-forming surface, releasing said particles forming said substreams of substantially uniform thickness when said particles are moving in the same direction as and adjacent to said filler rod-forming surface and at substantially the same speed thereas, depositing said particles immediately after said release from said moving surfaces onto said rod-forming surface or onto tobacco particles already located on the receiving surface while maintaining the relative locations of the tobacco particles one to another substantially the same under the influence of said suction on said rod-forming surface to build up a tobacco filler rod on the filler rod-forming surface by gentle layering of the particles of the respective substreams deposited from the moving surfaces one on top of another with substantially no intermixing of particles between the layers, conveying said tobacco filler rod under the influence of suction along a flow path to a wrapping operation wherein said filler rod is compressed and wrapped in paper to form a continuous cigarette rod, laterally confining said filler rod on said air-permeable and tobacco-impermeable surface during formation thereof and in said flow path by side wall members laterally spaced apart from each other substantially the same distance from about 5 to about 10 mm along said lateral confinement, and moving said side walls at substantially the same speed as said filler rod on said surface and in said flow path.

6. The process of claim 5 including providing said filler rod-forming surface and said flow path as part of a recessed periphery of a suction wheel rotating about a horizontal axis and including radial extremities adjacent the recessed periphery to provide said side wall members.

7. The process of claim 6, wherein said cylindrical members are arranged with the axes thereof lying substantially on an arc of a circle concentric with said suction wheel.

8. The process of claim 6, wherein said continuous surface of said cylindrical members has a width substantially the same as said lateral spacing apart of said side wall members.

9. The process of claim 6 wherein said wrapping operation includes releasing said filler rod from the recessed periphery of said suction wheel, depositing said released filler rod directly onto a continuous band of cigarette paper having a channel-shaped cross section while preventing any substantial increase in the lateral dimension of said filler rod, and confining said deposited filler rod on said paper band while said filler rod is compressed to a desired diameter for said wrapping in said cigarette paper band to form said continuous cigarette rod to prevent any substantial increase in cross-sectional area of said filler rod from said release of said filler rod from said suction wheel to said wrapping.

10. The process of claim 6 wherein said wrapping operation includes moving a continuous paper band having a channel-shaped cross section in a substantially horizontal path through said compression and said wrapping, said continuous paper band passing adjacent to, generally tangential to and in the same direction as said recessed periphery of said suction wheel on the vertical side thereof opposite to said rod-forming surface at a linear speed substantially equal to the curvilinear speed of said suction wheel, releasing said filler rod from said recessed periphery of said wheel at said tangential location of said paper band to said periphery, depositing said released filler rod directly onto said paper band while laterally confining the tobacco particles between said side wall members to prevent any substantial increase in the lateral dimension of said filler rod, and conveying said filler rod on said paper band from said tangential location to said wrapping while compressing said filler rod substantially wholly between surfaces moving at the same speed as said filler rod to prevent any substantial increase in cross sectional area of said filler rod from said release of said filler rod from said suction wheel to said wrapping.

11. The process of claim 10 wherein said conveying between moving surfaces is achieved by confining said filler rod from below and at the sides by said channel-shape of said cigarette paper band and from above by an elongate band substantially flat across its width moving in the direction of said cigarette paper band.

* * * * *